US007607949B2

(12) United States Patent
Hsu

(10) Patent No.: US 7,607,949 B2
(45) Date of Patent: Oct. 27, 2009

(54) UNIVERSAL SLOT

(75) Inventor: Ming-Chih Hsu, Peitou (TW)

(73) Assignee: Asustek Computer Inc., Taipei (TW)

( * ) Notice: Subject to any disclaimer, the term of this patent is extended or adjusted under 35 U.S.C. 154(b) by 0 days.

(21) Appl. No.: 12/109,823

(22) Filed: Apr. 25, 2008

(65) Prior Publication Data

US 2008/0268704 A1 Oct. 30, 2008

(30) Foreign Application Priority Data

Apr. 26, 2007 (TW) ..... 96114839

(51) Int. Cl.
*H01R 24/00* (2006.01)

(52) U.S. Cl. ..... 439/637; 439/267

(58) Field of Classification Search ..... 439/267, 439/637, 260, 265, 325, 636, 630
See application file for complete search history.

(56) References Cited

U.S. PATENT DOCUMENTS

| | | | | |
|---|---|---|---|---|
| 5,197,887 | A | 3/1993 | Davidge et al. | |
| 5,239,748 | A * | 8/1993 | Hamilton | 29/843 |
| 2005/0059301 | A1 | 3/2005 | Chou et al. | |
| 2006/0172560 | A1 | 8/2006 | Lai | |
| 2006/0189213 | A1 | 8/2006 | Hsiao | |

FOREIGN PATENT DOCUMENTS

CN 2308988 2/1999

OTHER PUBLICATIONS

English language translation of abstract of CN 2308988.

* cited by examiner

*Primary Examiner*—Ross N Gushi
(74) *Attorney, Agent, or Firm*—Thomas, Kayden, Horstemeyer & Risley

(57) ABSTRACT

A universal slot disposed on a base plate includes a first slot and a second slot. The first slot has a first electrical characteristic, and the second slot has a second electrical characteristic. The second slot covers the first slot in appearance.

5 Claims, 4 Drawing Sheets

UNIVERSAL SLOT

RELATED APPLICATIONS

This application claims priority to Taiwan Application Serial Number 96114839, filed Apr. 26, 2007, which is herein incorporated by reference.

BACKGROUND OF THE INVENTION

1. Field of the Invention

The invention relates to a slot structure and, more particularly, to a universal slot.

2. Description of the Related Art

With the progress of the computer science and technology, new transmission interface is developed by innovating. To increase the transmission speed of the interface, many different specifications are developed for different kinds of slots on the motherboard in the several decades that the computer is developed for.

To increase the competition of the products, motherboard manufacturers usually provides various slot specifications on the products to allow the products to be compatible and decrease the rate of replacing the interface cards. However, the area of the motherboard should meet specific specifications, and room for providing slots also is limited. A motherboard cannot be provided with too many slots. Motherboard manufacturers need to consider how to provide slots with a proper quantity and specifications when designing products.

Therefore, manufacturers hopes to increase the flexibility of replacing interface cards with different specifications and increase the competition of the products by decreasing the area occupied by slots with different specifications on the motherboard and considering both the slot quantity and the slot specification.

BRIEF SUMMARY OF THE INVENTION

The objective of the invention is to provide a universal slot for allowing interface cards with different specifications to be received in a single slot.

According to the objective of the invention, a universal slot disposed on a base plate is provided. The universal slot has a first slot and a second slot. The first slot has a first electrical characteristic corresponding to the first slot and a plurality of first metal elastic members disposed correspondingly to the first electrical characteristic. The first slot further includes a first opening located at a first height. The second slot has a second electrical characteristic corresponding to the second slot. The second slot further includes a second opening located at the second height. The second slot covers the first slot in appearance. The second opening and the first opening have the same opening direction. The opening direction is perpendicular to the base plate. The first slot is disposed in the second slot, and the first opening and the second opening are located at the same vertical plane relative to the base plate. In addition, the second slot further has a plurality of second metal elastic members disposed according to the second electrical characteristic. The second metal elastic members do not contact the first slot structurally.

Two slots with different electrical specifications are allowed to be disposed in a universal slot, and therefore, a single universal slot may receive two interface cards with different specifications. Thus, the area occupied by slots with different specifications on the motherboard is decreased, the flexibility of replacing interface cards with different specifications is increased, and the competition of the products is increased.

These and other features, aspects, and advantages of the present invention will become better understood with regard to the following description, appended claims, and accompanying drawings.

DETAILED DESCRIPTION OF THE EMBODIMENTS

In a universal slot of the embodiment of the invention, a slot with a specific electrical specification is disposed in another slot with another electrical specification, and then a single slot may receive two kinds of interface cards with different specifications. People having ordinary skills may choose proper electrical specification to implement to meet different usage and design within the spirit and range of the invention.

First Embodiment

Figure 1:
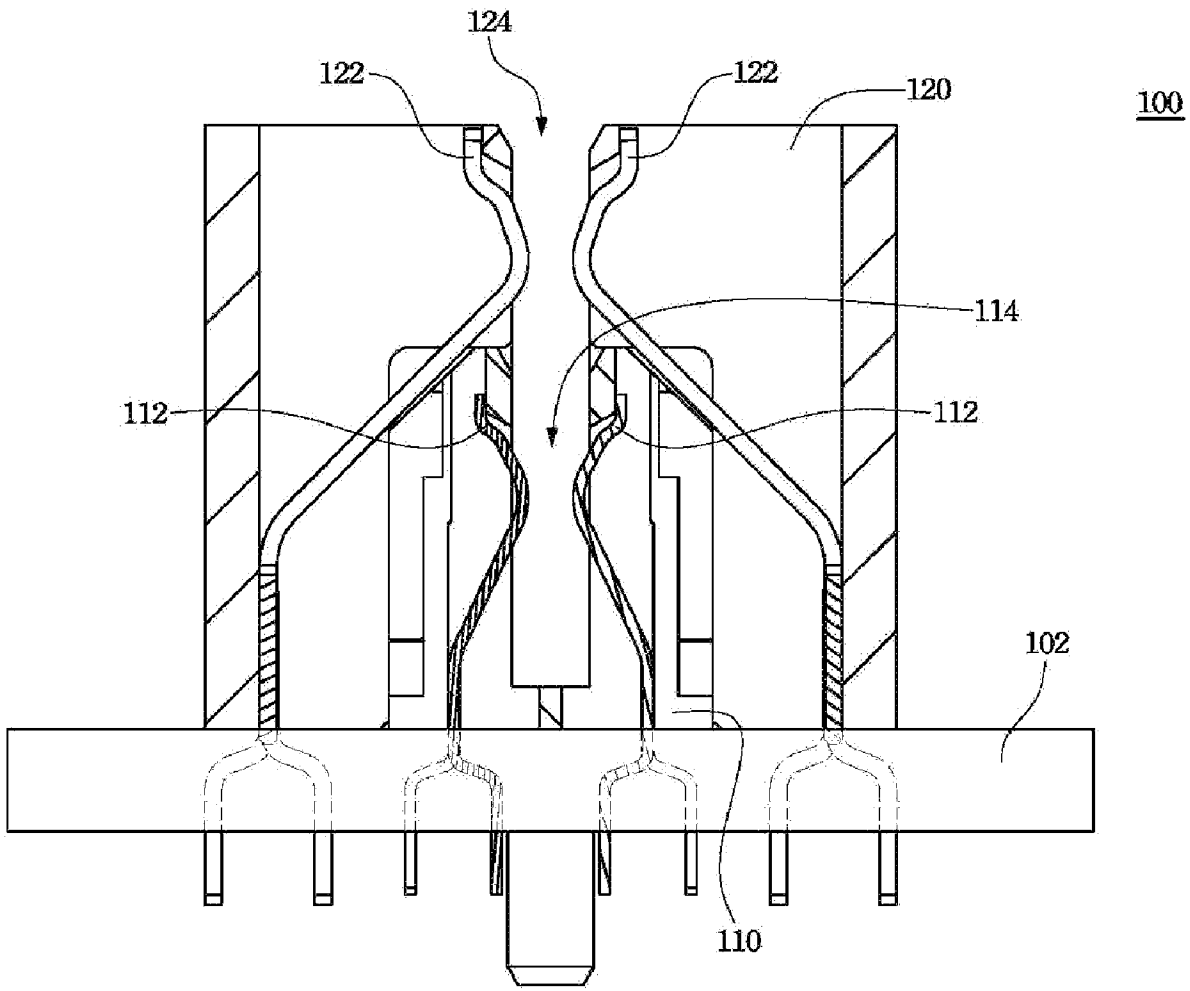
FIG. 1 is a section diagram showing a universal slot according to the first embodiment of the invention.

FIG. 1 is a section diagram showing a universal slot 100 of the first embodiment of the invention. The universal slot 100 is disposed on the base plate 102. The universal slot 100 includes a first slot 110 and a second slot 120. The first slot 110 has a first electrical characteristic corresponding to the first slot 110 and a plurality of first metal elastic members 112 disposed correspondingly to the first electrical characteristic. The first opening 114 of the first slot 110 is located at the first height. The interface card may be inserted into the first slot 110 from the first opening 114.

The second slot 120 has a second electrical characteristic corresponding to the second slot 120. The second slot 120 includes a second opening 124 located at the second height. The first slot 110 is disposed in the second slot 120, and the first opening 114 and the second opening 124 are located at the same plane which is perpendicular to the base plate 102.

In other words, for the universal slot 100, the second slot 120 covers the first slot 110 in appearance. The first opening and the second opening have the same opening direction, and the opening direction is perpendicular to the base plate 102. Therefore, the interface card for the first slot 110 is allowed to be inserted into the first opening 112 via the second opening 124 and is allowed to be installed in the first slot 110.

In addition, the second slot 120 further includes a plurality of second metal elastic members 122 disposed according to the second electrical characteristic. The second metal elastic members 122 do not contact the first slot 110 structurally. Since the first slot 110 is disposed in the second slot 120, the second height that the second opening 124 is located at is higher than the first height that the first opening 114 is located at.

For different electrical characteristic, the position where the interface card contacts the metal elastic member is different. In the embodiment, two slots with different electrical characteristics are installed in a universal slot to increase the number of kinds of the interface cards which may be received in a single slot.

Second Embodiment

In the first embodiment, for the design of the universal slot, the different position where the interface card with a different electrical characteristic contacts the metal elastic member is considered. However, to avoid some special conditions, the universal slot may be provided with auxiliary device additionally. For example, if the insulating paint of the interface card has a gap, the interface card inserted in the first slot may be electrically connected to the second metal elastic member, and the system may be unstable or have errors.

Figure 2:
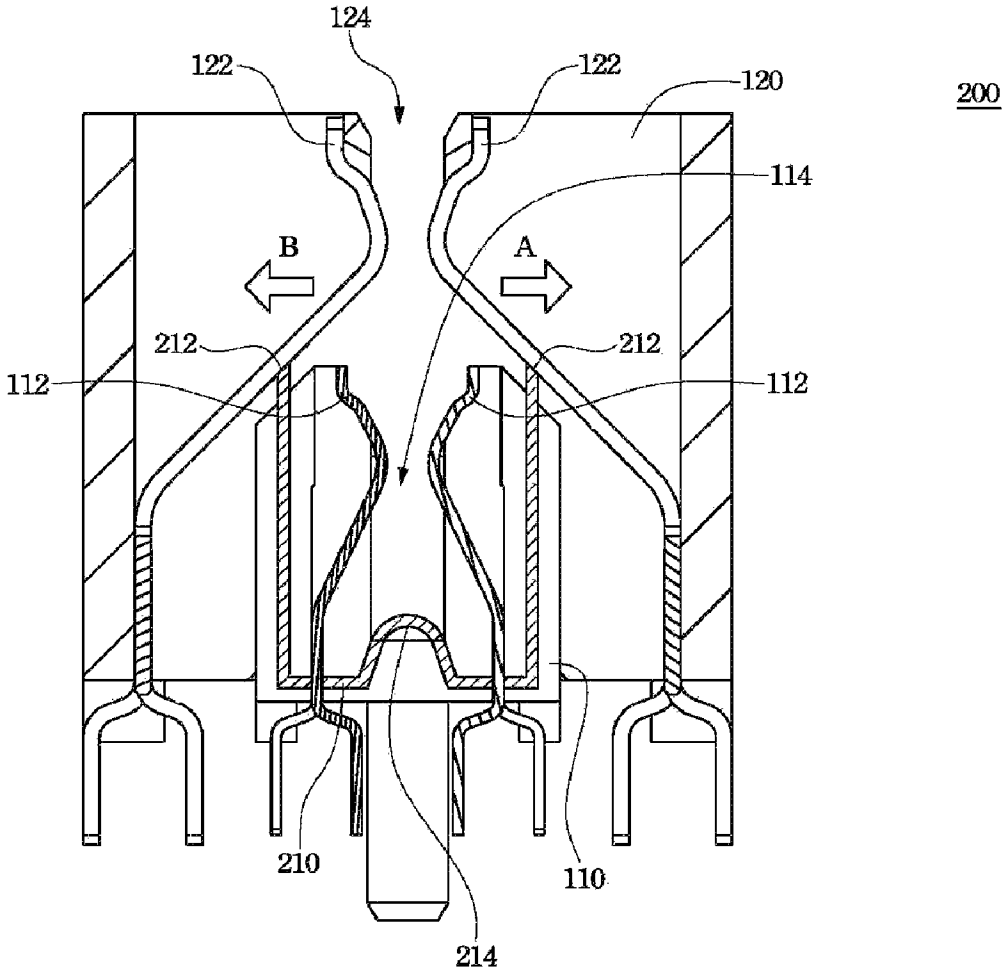
FIG. 2 is a section diagram showing a universal slot according to the second embodiment of the invention.

FIG. 2 is a section diagram showing a universal slot 200 of the second embodiment of the invention. The second embodiment is about same with the first embodiment. Therefore, mostly of elements are not described for concise purpose. In this embodiment, a supporting structure 210 is disposed in the universal slot 200. The supporting structure 210 has a stress point 214 and a plurality of supporting portion 212. The stress point 214 is disposed at the bottom of the first slot 110. The supporting portion 212 is disposed correspondingly to the second metal elastic members 122 to allow the supporting portion 212 to be against one side of the second metal elastic members 122. When a force is applied to the stress point 214 downward, the supporting portion 212 opens the second metal elastic members 212 toward two sides.

That is, when the interface card is inserted into the first slot 110, the bottom of the interface card presses the stress point 214 to provide the stress point 214 with a downward external force, and then the supporting portion 212 supports the second metal elastic members 122 upward. Thus, the second metal elastic member 122 is opened toward the directions of the arrow A and arrow B. Thus, the interface card does not contact the second metal elastic members 122, which avoids the condition that the interface card for the first slot 110 electrically contacts the second metal elastic members 122 to cause the system to be unstable or to have errors.

Third Embodiment

Figure 3A:
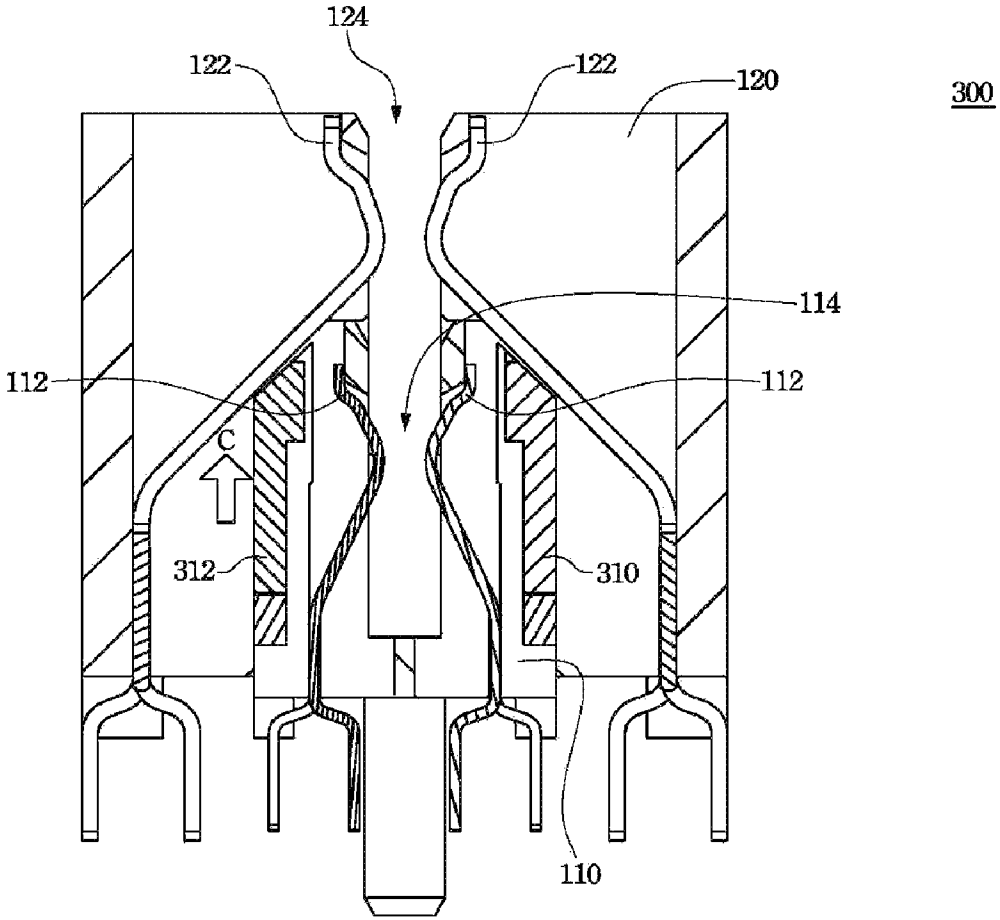
FIG. 3A is a section diagram showing a universal slot according to the third embodiment of the invention.
Figure 3B:
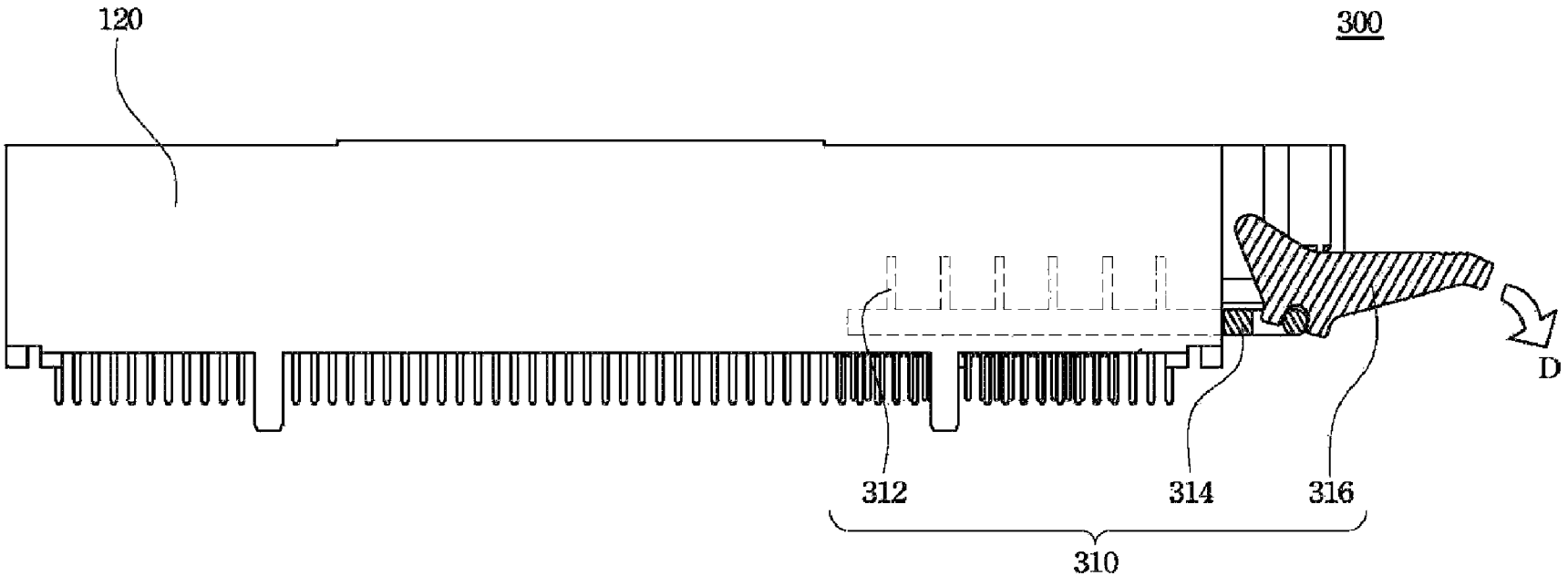
FIG. 3B is a lateral diagram showing a universal slot according to the third embodiment of the invention.

Besides the implanting manner in the second embodiment, another design having the similar function is provided. FIG. 3A is a section diagram showing a universal slot 300 of the third embodiment of the invention. FIG. 3B is a lateral diagram showing the universal slot 300 of the third embodiment of the invention. In this embodiment, a pushing structure 310 is disposed in the universal slot 300. The pushing structure 310 includes a lever switch 316, a plurality of pushing portions 312 and a connecting portion 314. The lever switch 316 is disposed at one end of the second slot 120. The pushing portion 312 is disposed correspondingly to the second metal elastic members 122 and is connected to the lever switch 316 via the connecting portion 314.

When the lever switch 316 is pressed toward the arrow D, the pushing portion 312 pushes toward the direction of the arrow C and opens the second metal elastic members 122. The interface card does not contact the second metal elastic members 122 via the disposition of the pushing structure 310, which avoids the condition that the interface card inserted into the first slot 110 electrically contacts the second metal elastic members 122 to cause the system to be unstable and have errors.

In practical application, the first slot corresponds to the electrical characteristic of PCI Express X1/X4, and the second slot corresponds to the electrical characteristic of PCI. Via the parameter settings of metal elastic members and the slot length between the PCI Express X1/X4 and PCI, the first slot of the universal slot may be designed to be compatible to the PCI Express X1/X4, and the second slot may be designed to be compatible to the PCI. Thus, the single universal slot may selectively receive the interface card with the PCI Express X1/X4 or the PCI specification.

In the embodiment of the invention, two slots with different electrical characteristic specifications may be disposed in the universal slot. Therefore, a single universal slot may receive two kinds of interface cards with different specifications, which may decrease the area occupied by slots with different specifications, increase the flexibility of replacing interface card with different specification and increase the competition of the products.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A universal slot disposed on a base plate, the universal slot comprising:

a first slot having a first electrical characteristic corresponding to the first slot and a plurality of first metal elastic members disposed correspondingly to the first electrical characteristic, the first slot further comprising a first opening located at a first height;

a second slot having a second electrical characteristic corresponding to the second slot and further comprising a second opening located at a second height, wherein the first slot is disposed in the second slot, the first opening and the second opening are located on a same plane which is perpendicular to the base plate, and the second slot further comprises a plurality of second metal elastic members disposed correspondingly to the second electrical characteristic; and a supporting structure having at least one stress point disposed at the bottom of the first slot and at least one supporting portion disposed correspondingly to the second metal elastic members, and when an external force is applied to the stress points downward, the supporting portion opens the second metal elastic members toward two sides.

2. The universal slot according to claim 1, wherein the second slot covers the first slot, and the second opening and the first opening have a same opening direction which is perpendicular to the base plate.

3. The universal slot according to claim 1, wherein the second height is higher than the first height.

4. The universal slot according to claim 1, wherein the first slot corresponds to the electrical characteristic of PCI Express X1/X4, and the second slot corresponds to the electrical characteristic of PCI.

5. A universal slot disposed on a base plate, the universal slot comprising:

a first slot having a first electrical characteristic corresponding to the first slot and a plurality of first metal elastic members disposed correspondingly to the first electrical characteristic, the first slot further comprising a first opening located at a first height;

a second slot having a second electrical characteristic corresponding to the second slot and further comprising a second opening located at a second height, wherein the first slot is disposed in the second slot, the first opening and the second opening are located on a same plane which is perpendicular to the base plate, and the second slot further comprises a plurality of second metal elastic members disposed correspondingly to the second electrical characteristic; and a pushing structure having a lever switch disposed at one end of the second slot and a plurality of pushing portions disposed correspondingly to the second metal elastic members and connected to the lever switch via a connecting portion, and when the lever switch is pressed, the pushing portions pushes upward and opens the second metal elastic members.

* * * * *